US005373914A

United States Patent [19]

Maher

[11] Patent Number: 5,373,914

[45] Date of Patent: Dec. 20, 1994

[54] REFRIGERANT COMPRESSOR OIL CHANGE FITTING

[76] Inventor: Charles T. Maher, 1022H E. Callowhill Rd., Chalfont, Pa. 18914

[21] Appl. No.: 119,574

[22] Filed: Sep. 13, 1993

[51] Int. Cl.[5] ..... F16C 3/14; F16N 33/00

[52] U.S. Cl. ..... 184/1.5; 184/105.3; 184/109

[58] Field of Search ..... 184/1.5, 6.5, 6.16, 184/6.18, 105.3; 62/292; 417/269, 220

[56] References Cited

U.S. PATENT DOCUMENTS

| | | | |
|---|---|---|---|
| 3,996,765 | 12/1976 | Mullins . | |
| 4,269,237 | 5/1981 | Berger | 184/1.5 |
| 4,338,793 | 7/1982 | O'Hern, Jr. . | |
| 4,709,722 | 12/1987 | Knapp | 184/1.5 |
| 4,745,894 | 5/1988 | Laipply et al. | 184/1.5 |
| 4,951,723 | 8/1990 | Hoeptner, III . | |
| 4,977,978 | 12/1990 | Batrice . | |
| 5,062,773 | 11/1991 | Kawai et al. | 184/6.16 |

FOREIGN PATENT DOCUMENTS

| | | | |
|---|---|---|---|
| 1016076 | 6/1956 | Germany | 184/6.16 |
| 0081187 | 5/1982 | Japan | 184/1.5 |

*Primary Examiner*—Thomas E. Denion
*Attorney, Agent, or Firm*—Rhodes & Ascolillo

[57] ABSTRACT

A fitting for connection to a threaded drain hole of a crankcase of a compressor, the fitting including a tool engaging member having surfaces thereon for engagement and rotation by a tool, a drain plug projecting in a first direction from the tool engaging member, the drain plug being externally threaded for engagement with the threaded drain hole, a connection member for connection to a refrigeration service hose having an internally threaded connection, the connection member having an externally threaded surface for engagement with the internally threaded connection of the refrigeration service hose, the connection member projecting from the tool engaging member in a second direction substantially opposite to the first direction, a channel passing through each of the drain plug, the tool engaging member, and the connection member, and a depressible valve core disposed within the channel and within the connection member.

19 Claims, 3 Drawing Sheets

REFRIGERANT COMPRESSOR OIL CHANGE FITTING

BACKGROUND

1. Field of the Invention

The present invention relates to the field of compressors, more particularly, to tools and fittings specifically designed and adapted for facilitating the task of changing the oil in a compressor having a crankcase which contains both a lubricating oil and a refrigerant, for example, a chlorofluorocarbon, also referred to as a "CFC".

2. Description of the Related Art

U.S. Pat. No. 4,977,978 relates to an oil change apparatus for use in changing the oil in a motor vehicle that includes a key operated drain valve removably mounted within a lockable protective housing and a flexible line connecting the drain valve with the engine oil pan of the motor vehicle.

U.S. Pat. No. 4,951,723 relates to a motorcycle engine oil drain plug that includes a tube that threads into the drain hole of the engine, a port provided in the tube, and a piston that is movable to cover and uncover the port.

U.S. Pat. No. 4,745,894 relates to an oil drain fitting for internal combustion engines that includes a body threaded into the conventional oil pan drain hole with an axial passage having a tubular valve reciprocally mounted therein.

U.S. Pat. No. 4,338,793 relates to an adapter for connection to an original equipment "Schrader" valve commonly found in closed refrigeration systems, the adapter including a duplicate "Schrader" valve that is oriented perpendicularly to the original equipment "Schrader" valve and is thus more easily accessible.

U.S. Pat. No. 3,996,765 relates to a device for removing or adding fluid refrigerant to a closed refrigerant system that includes a body having a passageway therethrough provided at its respective ends with threaded members for connecting the device to an access valve of the refrigerant system and to a refrigerant charging hose.

SUMMARY OF THE INVENTION

Changing the oil in refrigerator compressors is not only messy, but also involves the potential danger of expensive and harmful refrigerant leaks. Recent environmental concerns have resulted in the passage of a number of regulations that prohibit or restrict the discharge of various substances commonly used as refrigerants, for example, chlorofluorocarbon, into the atmosphere.

Accordingly, one object of the present invention is the provision of a compressor fitting that allows the oil in compressors to be changed with very little, if any, discharge of refrigerant into the atmosphere.

Another object of the invention is the provision of a compressor fitting that allows the oil in the crankcase of the compressor_to be either added to or withdrawn from, again with substantially no discharge of refrigerant, and additionally, without the necessity of shutting down the compressor.

A further object of the invention is the provision of a compressor fitting that permits the withdrawal of samples of oil from the crankcase of the compressor, again without the loss of refrigerant and without requiring a shutdown of the compressor.

A still further object of the invention is the provision of a compressor fitting that allows a measurement to be taken of the internal crankcase pressure, without the loss of refrigerant and without requiring a shutdown of the compressor.

Yet another object of the present invention is the provision of such a compressor fitting that is simple in construction and operation and, therefore inexpensive to manufacture.

In one aspect, the invention generally features a fitting for connection to a threaded drain hole of a crankcase of a compressor, the fitting including: a tool engaging member having surfaces thereon for engagement and rotation by a tool; a drain plug projecting from one side of the tool engaging member, the drain plug being externally threaded for engagement with the threaded drain hole; a channel passing through both of the drain plug and the tool engaging member; and a depressible valve core disposed within the channel.

Preferably, the fitting additionally includes a connection member for connection to refrigeration service equipment, the connection member extending away from the tool engaging member; the refrigeration equipment includes a refrigeration service hose, the refrigeration service hose including an internally threaded connection, and the connection member has an externally threaded surface for engagement with the internally threaded connection of the refrigeration service hose; the drain plug, the tool engaging member, and the connection member all have a substantially common longitudinal axis, and the channel includes a substantially linear channel disposed along the substantially common longitudinal axis; the drain hole is located a substantial distance above the floor of the compressor crankcase, and the fitting additionally includes a tube member projecting outward from the drain plug; the tube member is substantially aligned with the substantially common longitudinal axis; the drain plug and the tool engaging member both have a substantially common longitudinal axis, the connection member has a longitudinal axis that is nonaligned with the substantially common longitudinal axis of the drain plug and the tool engaging member, and the fitting additionally includes a tubing section interconnecting the drain plug and the tool engaging member with the connection member; the channel follows a nonlinear path including at least one substantially oblique angle; the at least one oblique angle is a substantially right angle; the nonlinear path includes at least two oblique angles; each of the at least two oblique angles is a substantially right angle; the fitting additionally includes an additional tool engaging member having surfaces thereon for engagement and rotation by a tool, the additional tool engaging member being rigidly attached to the connection member, and the tubing section interconnecting the tool engaging member with the additional tool engaging member; and the tubing section is geniculate in shape.

In another aspect, the invention generally features a fitting for connection to a threaded drain hole of a crankcase of a compressor, the fitting including: a tool engaging member having surfaces thereon for engagement and rotation by a tool; a drain plug projecting in a first direction from the tool engaging member, the drain plug being externally threaded for engagement with the threaded drain hole; a connection member for connection to a refrigeration service hose having an internally threaded connection; the connection member having an externally threaded surface for engagement with the internally threaded connection of the refrigeration service hose; the connection member projecting from the tool engaging member in a second direction substantially opposite to the first direction; a channel passing through each of the drain plug, the tool engaging member, and the connection member; and a depressible valve core disposed within the channel and within the connection member.

Preferably, the drain plug, the tool engaging member, and the connection member all have a substantially common longitudinal axis, and the channel includes a substantially linear channel disposed along the substantially common longitudinal axis; the drain hole is located a substantial distance above the floor of the compressor crankcase, and the fitting additionally includes a tube member projecting outward from the drain plug along the substantially common longitudinal axis; the drain plug and the tool engaging member have a substantially common longitudinal axis, the connection member has a longitudinal axis that is substantially parallel to but offset from the substantially common longitudinal axis of the drain plug and the tool engaging member, and the channel extends along a geniculate path between the substantially common longitudinal axis of the drain plug and the tool engaging member and the longitudinal axis of the connection member; the geniculate path of the channel includes at least two oblique angles; and each of the oblique angles is a substantially right angle.

In yet another aspect, the invention generally features a fitting for connection to an internally threaded drain hole of a crankcase of a compressor, the fitting facilitating the passage of a fluid between the crankcase and a refrigeration service hose having internal threads, the fitting including: a tool rotatable member; a drain plug extending in a first direction from the tool rotatable member, the drain plug being provided with external threads for engaging the internally threaded drain hole; a connector member extending in a second direction from the tool rotatable member, the second direction being substantially opposite to the first direction; the connector member being provided with external threads for engaging the internal threads of the refrigeration service hose; the drain plug, the tool rotatable member, and the connector member having a substantially common longitudinal axis; a channel extending through the drain plug, the tool rotatable member, and the connector member, the channel being coaxial with the substantially common longitudinal axis of the drain plug, the tool rotatable member, and the connector member; and a depressible valve core disposed within the channel and adjacent the distal end of the connector member.

The invention will now be described by way of a particularly preferred embodiment, reference being made to the accompanying drawings, wherein:

DESCRIPTION OF THE PREFERRED EMBODIMENTS

Figure 3:
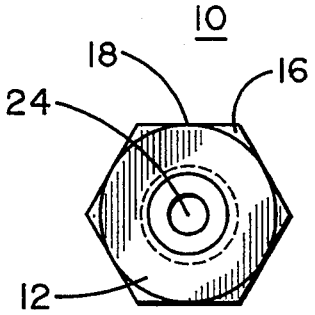
FIG. 3 is an end elevational view of the oil change fitting of FIGS. 1 and 2.
Figure 2:
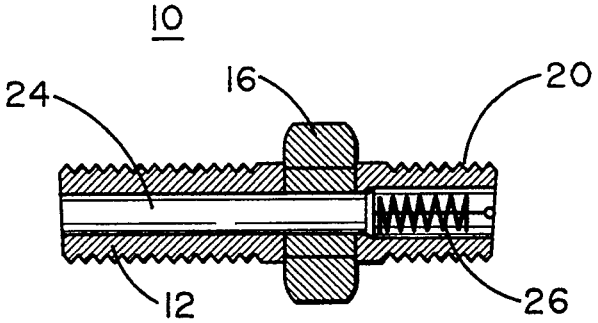
FIG. 2 is a cross sectional side elevational view of the oil change fitting of FIG. 1.
Figure 1:
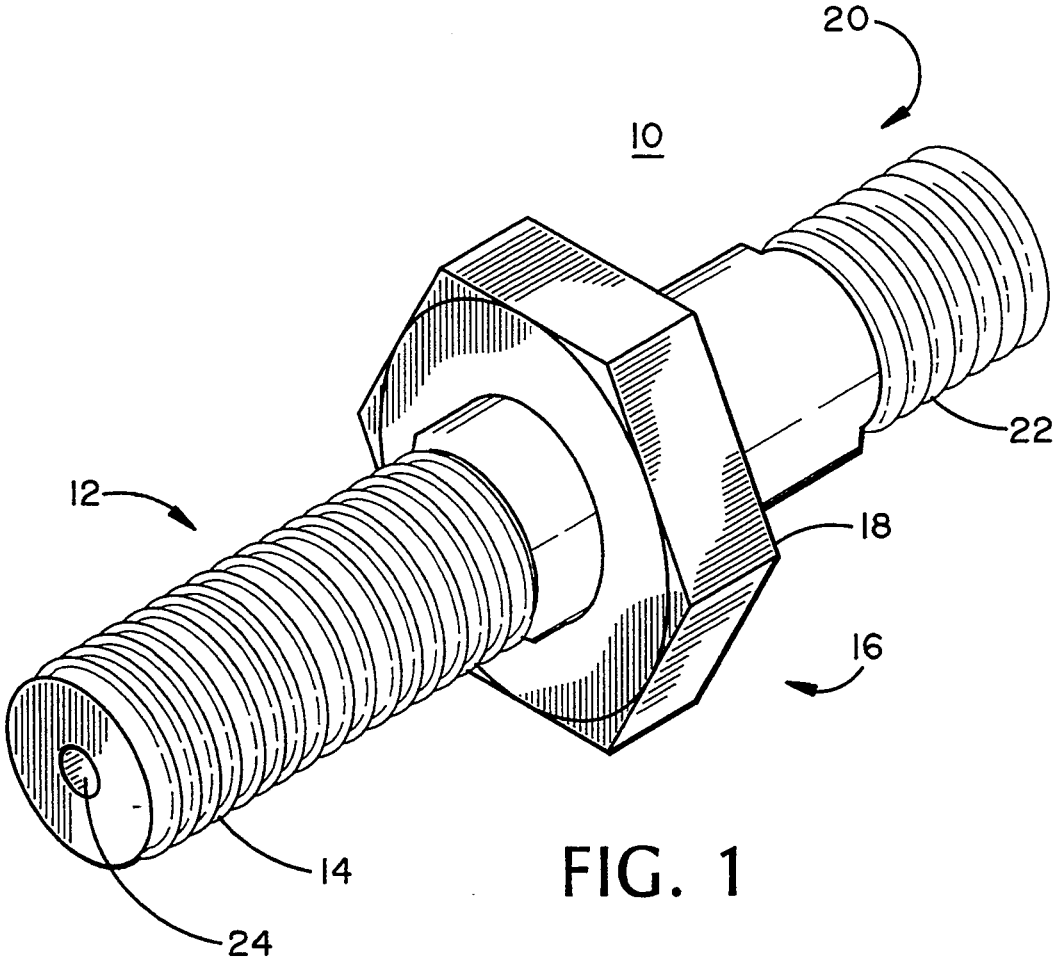
FIG. 1 is a perspective view of a first embodiment of a refrigerant compressor oil change fitting constructed according to the present invention.

Referring initially now to FIGS. 1–3, a first embodiment of a refrigerant compressor oil change fitting 10 constructed according to the present invention generally includes a drain plug member 12 that is provided with external threads 14 for engaging the internal threads of a drain hole that is conventionally provided in the crankcase of a compressor, a tool rotatable member 16 that is preferably provided with a number (e.g., six) so-called "flats" 18 thereabout for engagement by a hand tool (e.g., a wrench), and a connector member 20 that is also provided with external threads 22 for allowing connection of the connector member 20 to the connector of a conventional refrigeration service hose that is conventionally equipped with internal threads. The drain plug member 12, the tool rotatable member 16, and the connector member 20 are all rigidly interconnected, with the drain plug member 12 projecting in a first direction from the tool rotatable member 16, and the connector member 20 projecting in a second substantially opposite direction from the tool rotatable member 16.

In the embodiment of FIGS. 1–3, the drain plug member 12, the tool rotatable member 16, and the connector member 20 all are positioned with respect to one another such that they have a common longitudinal axis, and a channel 24, preferably substantially cylindrical in shape, extends through the fitting 10 coaxially therewith. A depressible valve core 26, for example, a valve of the type well known in the art and generally referred to as a "Schrader" valve, is positioned within the channel 24 adjacent the distal end of the connector member 20. A conventional refrigeration service hose, when connected to the connector member 20, will, as is well understood in the art, depress and thereby activate the depressible valve core 26, thereby allowing the flow of fluid (e.g., oil) therethrough. However, when the refrigeration service hose is uncoupled from the connector member 20, the depressible valve core 26 will, under the biasing action of its internal spring, terminate any flow through the channel 24.

The compressors for which the present invention is primarily designed have a lubricating oil that, during a stoppage of the compressor, falls to the bottom of the crankcase, where it is overlain by a refrigerant that is usually gaseous under normal atmospheric conditions. The embodiment of FIGS. 1–3 is primarily designed for compressors that have a drain hole located at or near the "floor" of the crankcase, such as, for example, compressors manufactured by Dunham-Bush. With the fitting 10 shown in FIGS. 1–3 installed within the drain hole of such compressors, a refrigeration service hose can be coupled to the connector member 20 so as to drain the oil from the crankcase without allowing any escape of the refrigerant that is located above the oil level in the crankcase. When any of the refrigerant begins to appear at the output of the refrigeration service hose, the hose can be loosened or disconnected so as to cause a closing of the depressible valve core 26. New oil can then be transferred through the refrigeration hose to replace the drained oil.

In order to install the fitting 10, the compressor must be initially "pumped down", that is, the existing refrigerant removed therefrom, and the fitting 10 installed in place of the existing drain plug. Thereafter, the compressor oil can be replaced without any necessity for simultaneously replacing the refrigerant. Additionally, the fitting 10 makes it possible to adjust the oil level of the compressor up or down, again without requiring the replacement of the refrigerant. Typically, in many compressors, the oil level should be maintained in approximately the middle of a so-called "sight glass". Still further, oil samples can be taken for analysis, for example, to determine the acidity thereof, the acidity of the oil being indicative of whether an overload or a burnout of the compressor has occurred. Moreover, a pressure reading of the compressor can be taken by attaching a pressure gauge to the refrigeration service hose, without requiring a shutdown of the compressor, that is, with the compressor still running.

Figure 6:
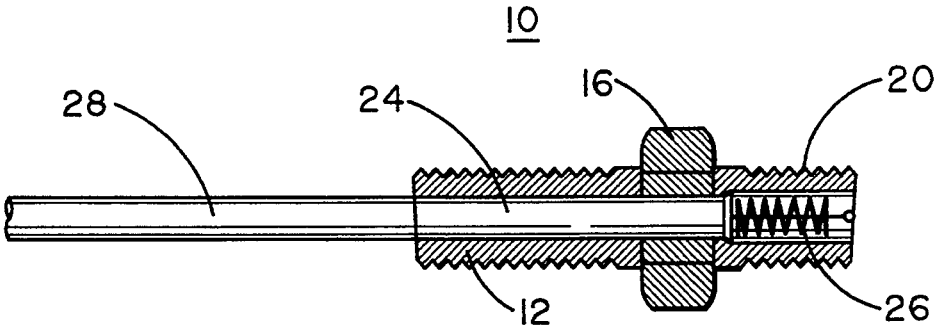
FIG. 6 is a cross sectional side elevational view of the oil change fitting of FIGS. 4 and 5.
Figure 5:
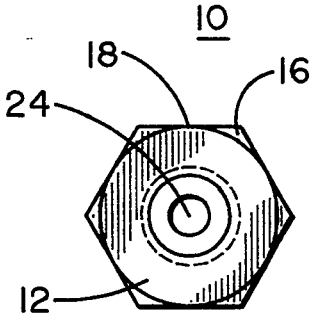
FIG. 5 is an end elevational view of the oil change fitting of FIG. 4.
Figure 4:
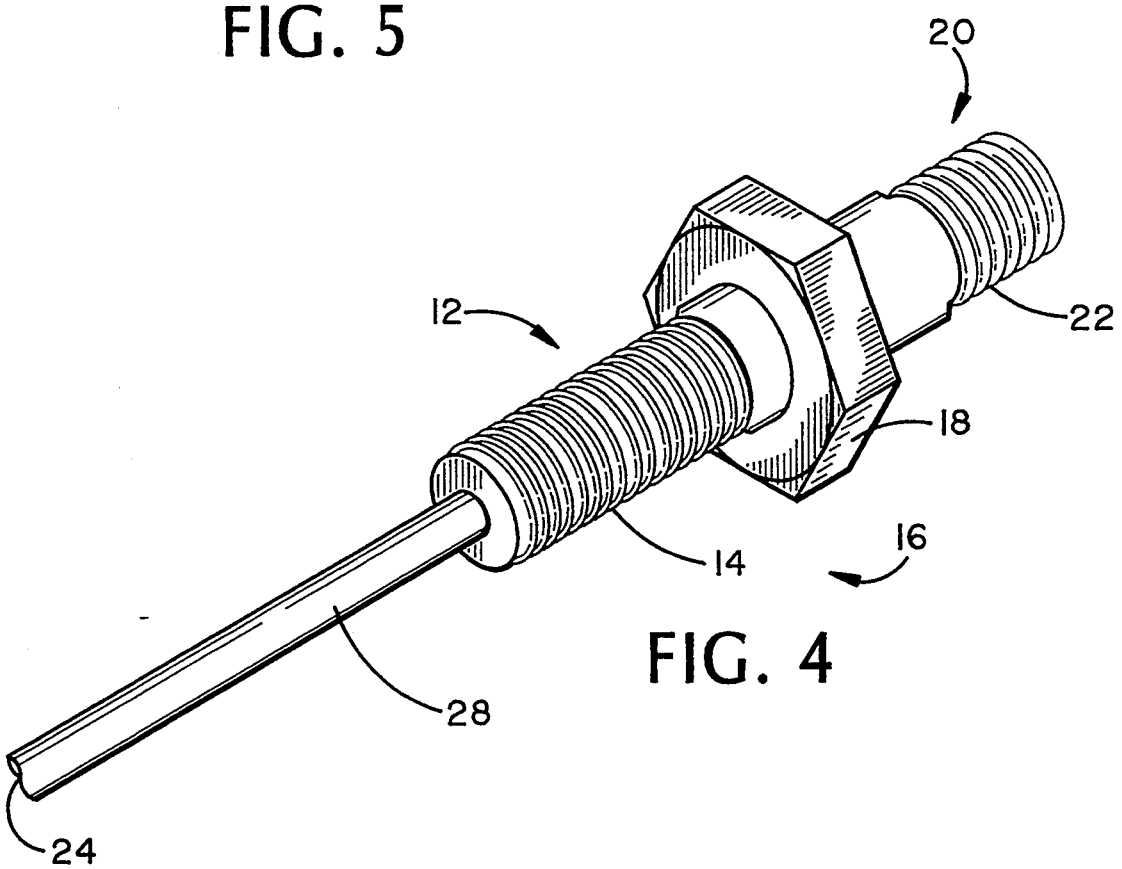
FIG. 4 is a perspective view of a second embodiment of a refrigerant compressor oil change fitting constructed according to the present invention.

A second embodiment of the present invention, shown in FIGS. 4–6, is particularly adapted for use in conjunction with compressors that have the drain hole located above the floor of the crankcase, for example, the semi-hermetic type of compressor manufactured by Copeland. In the embodiments illustrated in FIGS. 4–6 and 7–9, like reference numerals are used to reference elements of the same basic construction as those already discussed above, any specific differences in construction being noted.

The Copeland type of compressor has a drain hole that is positioned about three inches above the floor of the crankcase and which may be sloped at about a 45 degree angle from the vertical. Accordingly, the fitting shown in FIGS. 4–6 is provided with a tube 28 that projects outward from the drain plug member 12 and which will, when the fitting is installed in such a compressor, extend downward through the oil to a position adjacent the floor of the crankcase of the compressor. This ensures that the crankcase oil will be first removed during an oil change, prior to any refrigerant entering the fitting 10. Additionally, the embodiment of FIGS. 4–6 permits the oil pressure and samples for analysis to be obtained as described above.

Figure 8:
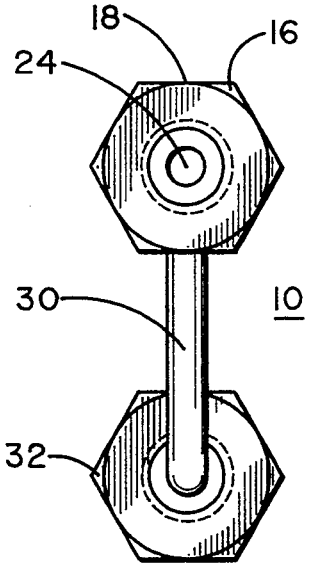
FIG. 8 is an end elevational view of the oil change fitting of FIG. 7.
Figure 9:
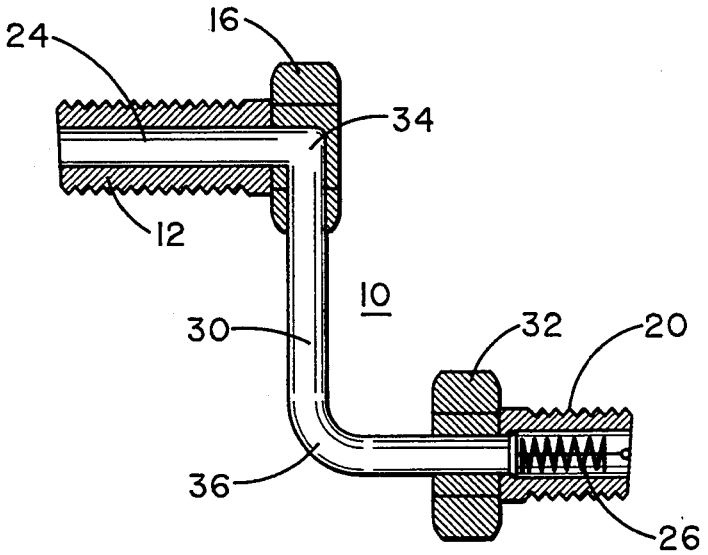
FIG. 9 is a cross sectional side elevational view of the oil change fitting of FIGS. 7 and 8.
Figure 7:
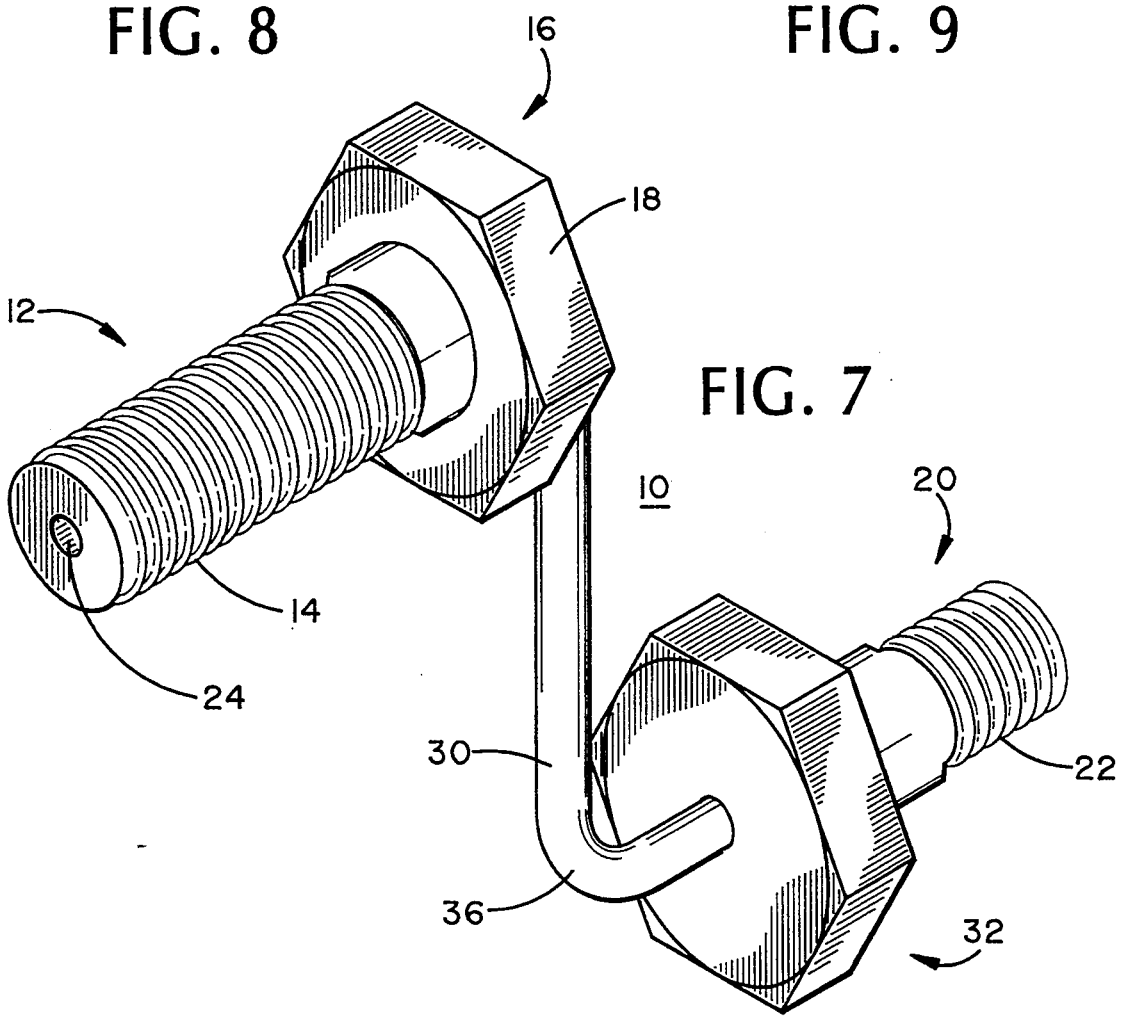
FIG. 7 is a perspective view of a third embodiment of a refrigerant compressor oil change fitting constructed according to the present invention.

A third embodiment of the invention, shown in FIGS. 7–9 is particularly adapted for use in situations where the drain hole of a particular compressor is located so as to be relatively unaccessible, or accessible only with difficulty. Here, the fitting 10 is provided with an extended geniculate (or bent in the shape of a knee) section of tubing 30 that extends between the tool rotatable member 16 and the connector member 20 and which encloses a portion of the channel 24, thereby allowing the connector member 20 to be positioned, depending upon the particular situation, so as to be more readily accessible for servicing. Moreover, in order to allow a positive connection to be made between the connector member 20 and a refrigeration hose, the connector member 20 is preferably provided with an additional tool rotatable member 32 rigidly attached thereto. The geniculate section of tubing 30 preferably extends downward from the tool rotatable member 16, thereby forming a first angled turn 34 in the channel 24 at this point, and makes at least one additional angled turn 36 at a point intermediate between the tool rotatable member 16 and the additional tool rotatable member 32. Preferably, as shown in FIGS. 7 and 9, both of the angled turns 34 and 36 of the channel 24 are right angled turns, such that the longitudinal axis of the connector member 20 is parallel to, but offset from, the common longitudinal axes of the drain plug member 12 and the tool rotatable member 16.

While the invention has been herein described by way of a number of particular preferred embodiments, various substitutions of equivalents may be effected without departing from the spirit and scope of the invention as set forth in the following claims.

What is claimed is:

1. A fitting for connection to a threaded drain hole of a crankcase of a compressor, said fitting comprising:

a tool engaging member having surfaces thereon for engagement and rotation by a tool;

a drain plug projecting from one side of said tool engaging member, said drain plug being externally threaded for engagement with the threaded drain hole;

a channel passing through both of said drain plug and said tool engaging member;

a depressible valve core disposed within said channel; and wherein said fitting additionally comprises a connection member for connection to refrigeration service equipment, said connection member extending away from said tool engaging member.

2. A fitting according to claim 1, wherein the refrigeration equipment comprises a refrigeration service hose, the refrigeration service hose including an internally threaded connection, and wherein said connection member has an externally threaded surface for engagement with the internally threaded connection of the refrigeration service hose.

3. A fitting according to claim 2, wherein said drain plug, said tool engaging member, and said connection member all have a substantially common longitudinal axis, and wherein said channel comprises a substantially linear channel disposed along said substantially common longitudinal axis.

4. A fitting according to claim 3, wherein the drain hole is located a substantial distance above a floor of the compressor crankcase, and wherein said fitting additionally comprises a tube member projecting outward from said drain plug.

5. A fitting according to claim 4, wherein said tube member is substantially aligned with said substantially common longitudinal axis.

6. A fitting according to claim 2, wherein said drain plug and said tool engaging member both have a substantially common longitudinal axis, wherein said connection member has a longitudinal axis that is nonaligned with said substantially common longitudinal axis of said drain plug and said tool engaging member, and wherein said fitting additionally comprises a tubing section interconnecting said drain plug and said tool engaging member with said connection member.

7. A fitting according to claim 6, wherein said channel follows a nonlinear path comprising at least one substantially oblique angle.

8. A fitting according to claim 7, wherein said at least one oblique angle is a substantially right angle.

9. A fitting according to claim 6, wherein said nonlinear path comprises at least two oblique angles.

10. A fitting according to claim 9, wherein each of said at least two oblique angles is a substantially right angle.

11. A fitting according to claim 10, wherein said fitting additionally comprises an additional tool engaging member having surfaces thereon for engagement and rotation by a tool, said additional tool engaging member being rigidly attached to said connection member, and said tubing section interconnecting said tool engaging member with said additional tool engaging member.

12. A fitting according to claim 6, wherein said tubing section is geniculate in shape.

13. A fitting for connection to a threaded drain hole of a crankcase of a compressor, said fitting comprising:

a tool engaging member having surfaces thereon for engagement and rotation by a tool;

a drain plug projecting in a first direction from said tool engaging member, said drain plug being externally threaded for engagement with the threaded drain hole;

a connection member for connection to a refrigeration service hose having an internally threaded connection;

said connection member having an externally threaded surface for engagement with the internally threaded connection of the refrigeration service hose;

said connection member projecting from said tool engaging member in a second direction substantially opposite to said first direction;

a channel passing through each of said drain plug, said tool engaging member, and said connection member; and a depressible valve core disposed within said channel and within said connection member.

14. A fitting according to claim 13, wherein said drain plug, said tool engaging member, and said connection member all have a substantially common longitudinal axis, and wherein said channel comprises a substantially linear channel disposed along said substantially common longitudinal axis.

15. A fitting according to claim 14, wherein the drain hole is located a substantial distance above a floor of the compressor crankcase, and wherein said fitting additionally comprises a tube member projecting outward from said drain plug along said substantially common longitudinal axis.

16. A fitting according to claim 15, wherein said drain plug and said tool engaging member have a substantially common longitudinal axis, wherein said connection member has a longitudinal axis that is substantially parallel to but offset from said substantially common longitudinal axis of said drain plug and said tool engaging member, and wherein said channel extends along a geniculate path between said substantially common longitudinal axis of said drain plug and said tool engaging member and said longitudinal axis of said connection member.

17. A fitting according to claim 16, wherein said geniculate path of said channel includes at least two oblique angles.

18. A fitting according to claim 17, wherein each of said oblique angles is a substantially right angle.

19. A fitting for connection to an internally threaded drain hole of a crankcase of a compressor, said fitting facilitating the passage of a fluid between the crankcase and a refrigeration service hose having internal threads, said fitting comprising:

a tool rotatable member;

a drain plug extending in a first direction from said tool rotatable member, said drain plug being provided with external threads for engaging the internally threaded drain hole;

a connector member extending in a second direction from said tool rotatable member, said second direction being substantially opposite to said first direction;

said connector member being provided with external threads for engaging the internal threads of the refrigeration service hose;

said drain plug, said tool rotatable member, and said connector member having a substantially common longitudinal axis;

a channel extending through said drain plug, said tool rotatable member, and said connector member, said channel being coaxial with said substantially common longitudinal axis of said drain plug, said tool rotatable member, and said connector member; and a depressible valve core disposed within said channel and adjacent the distal end of said connector member.

* * * * *